US008109180B2

(12) United States Patent
Hu

(10) Patent No.: US 8,109,180 B2
(45) Date of Patent: Feb. 7, 2012

(54) DUSTPROOF RING FOR RATCHET WRENCH

(76) Inventor: Bobby Hu, Taichung (TW)

( * ) Notice: Subject to any disclaimer, the term of this patent is extended or adjusted under 35 U.S.C. 154(b) by 368 days.

(21) Appl. No.: 12/566,740

(22) Filed: Sep. 25, 2009

(65) Prior Publication Data

US 2010/0186555 A1 Jul. 29, 2010

(30) Foreign Application Priority Data

Jan. 23, 2009 (TW) ..... 98103010 A

(51) Int. Cl.
*B25B 13/46* (2006.01)

(52) U.S. Cl. ..... 81/60; 81/63.1

(58) Field of Classification Search ..... 81/60–63, 81/63.1, 63.2

See application file for complete search history.

(56) References Cited

U.S. PATENT DOCUMENTS 4,934,220 A * 6/1990 Slusar et al. ..... 81/63.2
5,921,158 A * 7/1999 Slusar et al. ..... 81/63
6,125,722 A * 10/2000 Hopper et al. ..... 81/63
6,260,448 B1 * 7/2001 Chaconas ..... 81/63
6,591,718 B1 * 7/2003 Chang ..... 81/60
6,655,237 B2 * 12/2003 Chen ..... 81/60
6,981,435 B2 * 1/2006 Hsien ..... 81/63.2
7,311,019 B2 12/2007 Arnold et al. ..... 81/63.2
7,353,735 B2 * 4/2008 Patel et al. ..... 81/63
7,441,482 B2 * 10/2008 Lin ..... 81/62
2005/0193871 A1 * 9/2005 Hsien ..... 81/60

* cited by examiner

*Primary Examiner* — David B Thomas
(74) *Attorney, Agent, or Firm* — Alan Kamrath; Kamrath IP Lawfirm, PA

(57) ABSTRACT

A ratchet wrench includes a head rotatably receiving a drive member. The head includes an end wall having a hole. One of an inner face of the end wall and an end face of the drive member defines a first abutment face. The other of the inner face and the end face includes an annular groove having a bottom wall defining a second abutment face. A dustproof ring is mounted and compressed in the annular groove. The dustproof ring in an uncompressed state has a natural maximum height along a rotating axis of the drive member larger then a spacing between the first and second abutment faces. The dustproof ring includes three sealing units along a radial direction perpendicular to the rotating axis. Each sealing unit has a thickness along the rotating axis smaller than the spacing.

20 Claims, 14 Drawing Sheets

DUSTPROOF RING FOR RATCHET WRENCH

BACKGROUND OF THE INVENTION

The present invention relates to a dustproof ring and, more particularly, to a dustproof ring for preventing dust from entering a head of a ratchet wrench.

A type of ratchet wrench includes a head and a handle interconnected to the head. The head includes a first, open side and a second side having an end wall with a hole rotatably receiving a stub formed on an end face of a drive member received in a compartment defined between the first and second sides of the head. A cover plate is mounted to the first side of the head to enclose the compartment. A drive column extends beyond the cover plate for driving a socket or the like. A pawl is received in a pawl groove defined in a periphery defining the compartment. A switch is received in a switch groove in the head and engages with the pawl, so that the driving direction f the ratchet wrench can be changed by rotational movement of the switch between two positions. To prevent dust from entering the compartment of the head via the hole, an O-ring is mounted in an annular groove formed in an inner face of the end wall and in direct communication with the hole. A C-clip is mounted and imparts a force to an outer side of the cover plate, so that the end face of the drive member tightly compress the O-ring with upper and lower edges of the O-ring tightly sandwiched between the end face of the drive member and a bottom wall of the annular groove. An example of such a ratchet wrench is disclosed in U.S. Pat. No. 7,311,019. However, significant force is required to overcome the friction between the end face of the drive member and the lower edge of the O-ring and between the bottom wall of the annular groove and the upper edge of the O-ring, risking injury to the hand of a user.

Thus, a need exists for a novel dustproof ring capable of preventing dust from entering the ratchet wrench while allowing easy, smooth operation of the ratchet wrench.

BRIEF SUMMARY OF THE INVENTION

The present invention solves this need and other problems in the field of sealing of ratchet wrenches, by providing, in a preferred form, a ratchet wrench including a body having a head and a handle interconnected to the head. The head includes first and second sides spaced along a rotating axis. The head further includes a compartment extending from the first side through the second side. A pawl groove is defined in an inner periphery of the compartment. The second side of the head includes an end wall defining a hole in communication with the compartment. The end wall includes an inner face facing the compartment. A drive member rotatably received in the compartment about the rotating axis. The drive member includes first and second ends spaced along the rotating axis. The second end of the drive member includes an end face. A gap is formed between the end face and the inner face along the rotating axis. One of the end face and the inner face defines a first abutment face. The other of the end face and the inner face includes an annular groove having a bottom wall defining a second abutment face. A spacing is defined between the first and second abutment faces along the rotating axis. The first end of the drive member is adapted to drive an object. The drive member further includes an outer periphery extending between the first and second ends. A plurality of teeth is formed in the outer periphery of the drive member. A pawl is slideably received in the pawl groove and includes a side having a plurality of teeth engaged with the plurality of teeth of the drive member. A dustproof ring is mounted and compressed in the annular groove. The dust ring presses against the first and second abutment faces. The dustproof ring in an uncompressed state has a natural maximum height along the rotating axis larger than the spacing. The dustproof ring includes first, second, and third sealing units. The third sealing unit is radially outwards of the first sealing unit in a radial direction perpendicular to the rotating axis. The second sealing unit is interconnected to and intermediate the first and third sealing units in the radial direction. The first sealing unit includes a first thickness along a first axis parallel to and spaced from the rotating axis. The second sealing unit includes a second thickness along a second axis parallel to and spaced from the rotating axis and the first axis. The third sealing unit includes a third thickness along a third axis parallel to and spaced from the rotating axis and the first and second axes. The second axis is intermediate the first and third axes in the radial direction. Each of the first, second, and third thicknesses is smaller than the spacing. A buffering space is formed between the first and third sealing units. The buffering space receives deformed portions of the dustproof ring received in the annular groove.

In preferred forms, the first and third sealing units press against one of the first and second abutment faces, and the second sealing unit presses against the other of the first and second abutment faces. The buffering space includes a first buffering space section formed between the first sealing unit and one of the first and second abutment faces, a second buffering space section formed between the second sealing unit and the other of the first and second abutment faces, and a third buffering space section formed between the third sealing unit and the one of the first and second abutment faces. The dustproof ring received in the annular groove is compressed along the rotating axis and deformed along the rotating axis and in the radial direction. The first, second, and third buffering space sections are isolated from each other.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
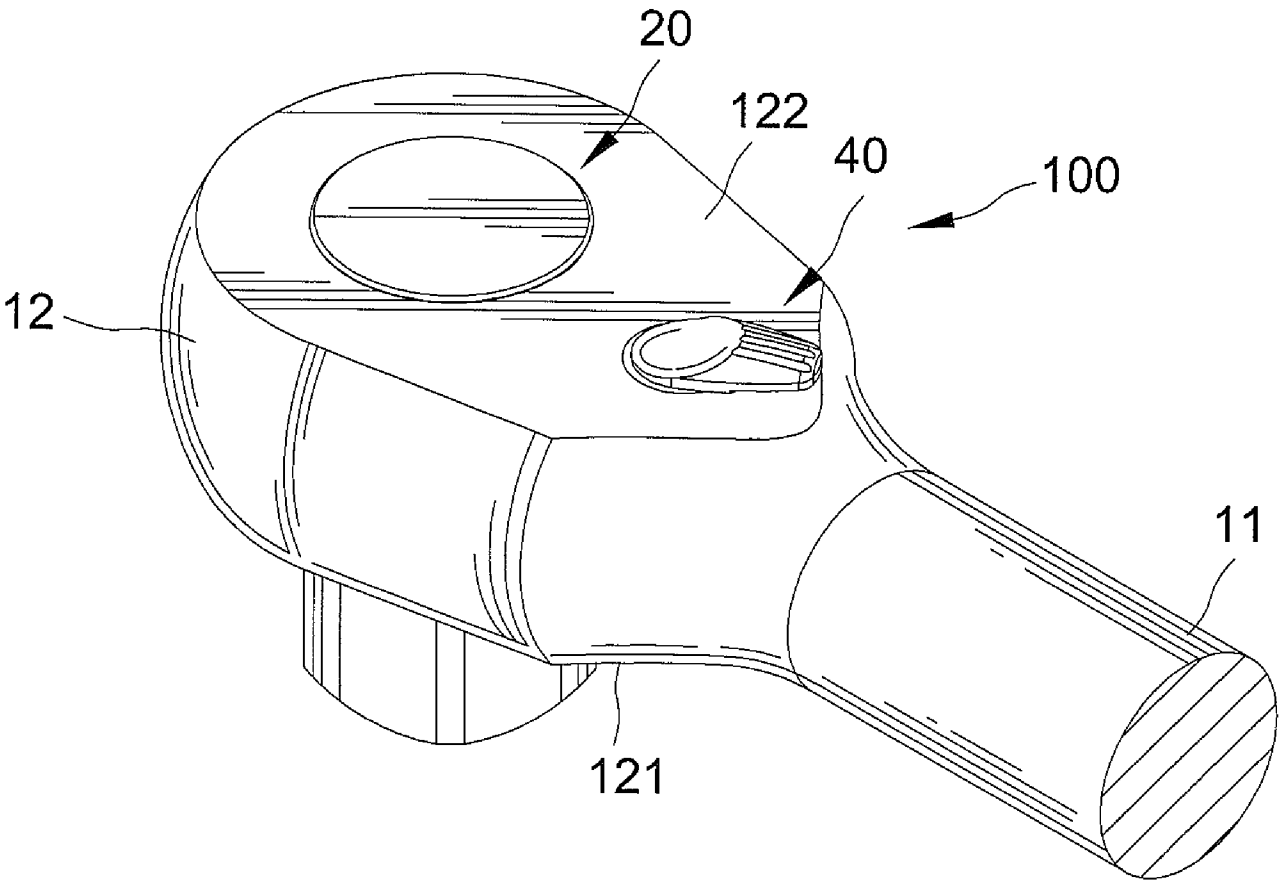
FIG. 1 shows a partial, perspective view of a ratchet wrench of a first embodiment according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "axial", "radial", "annular", "outward", "spacing", "clockwise", "counterclockwise", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
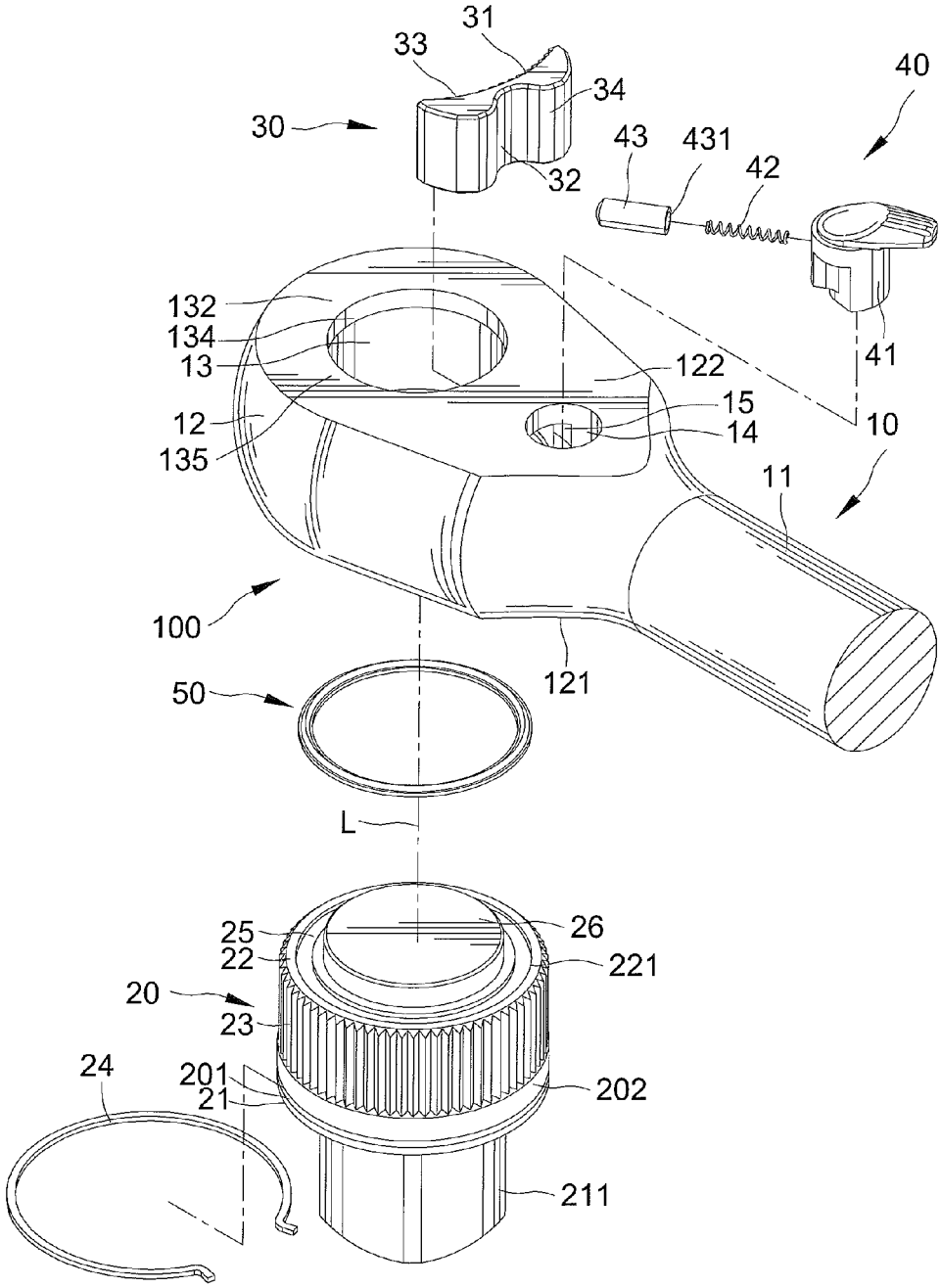
FIG. 2 shows an exploded, perspective view of the ratchet wrench of FIG. 1.
Figure 3:
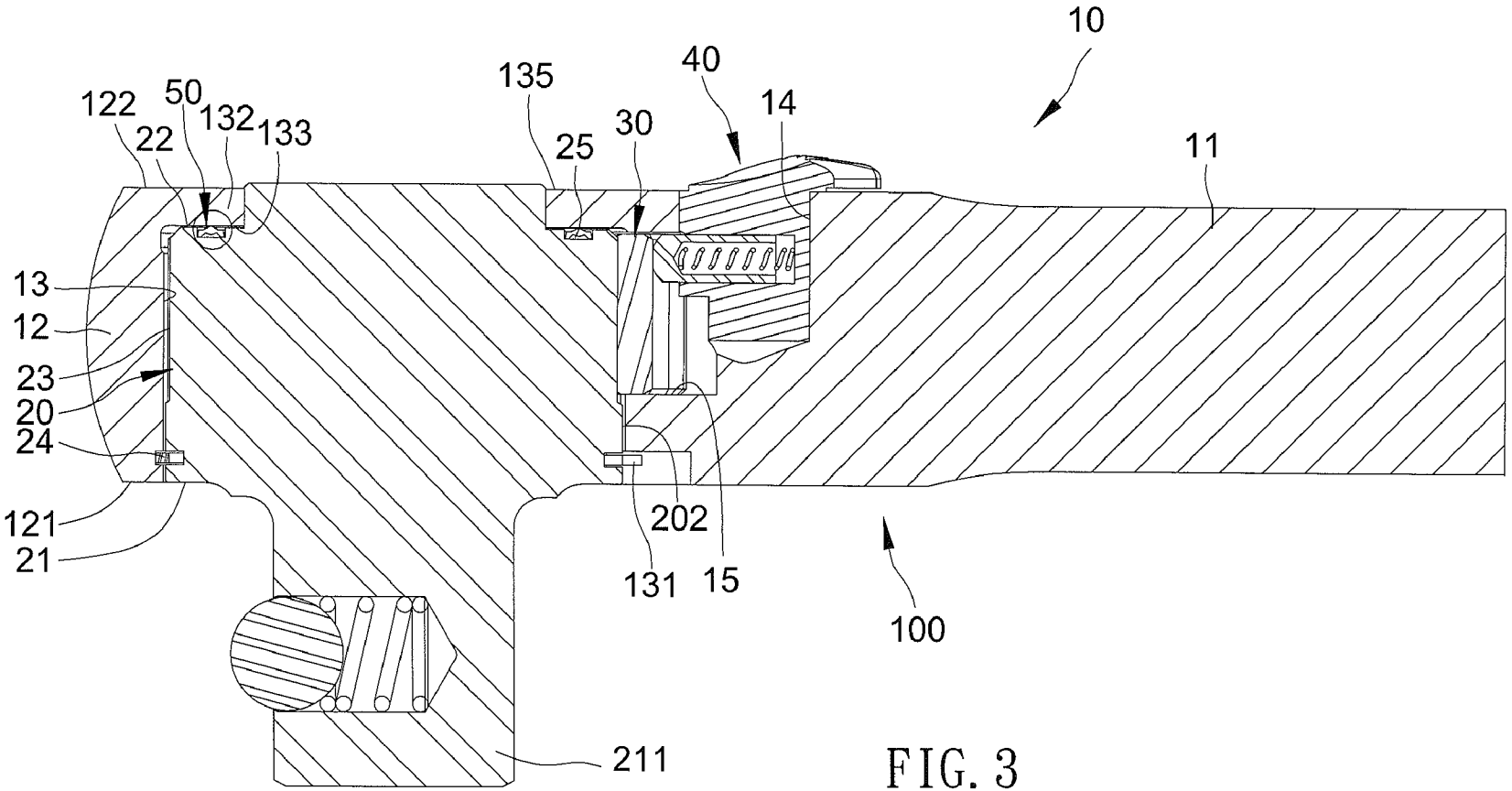
FIG. 3 shows a partial, cross sectional view of the ratchet wrench of FIG. 1.
Figure 4:
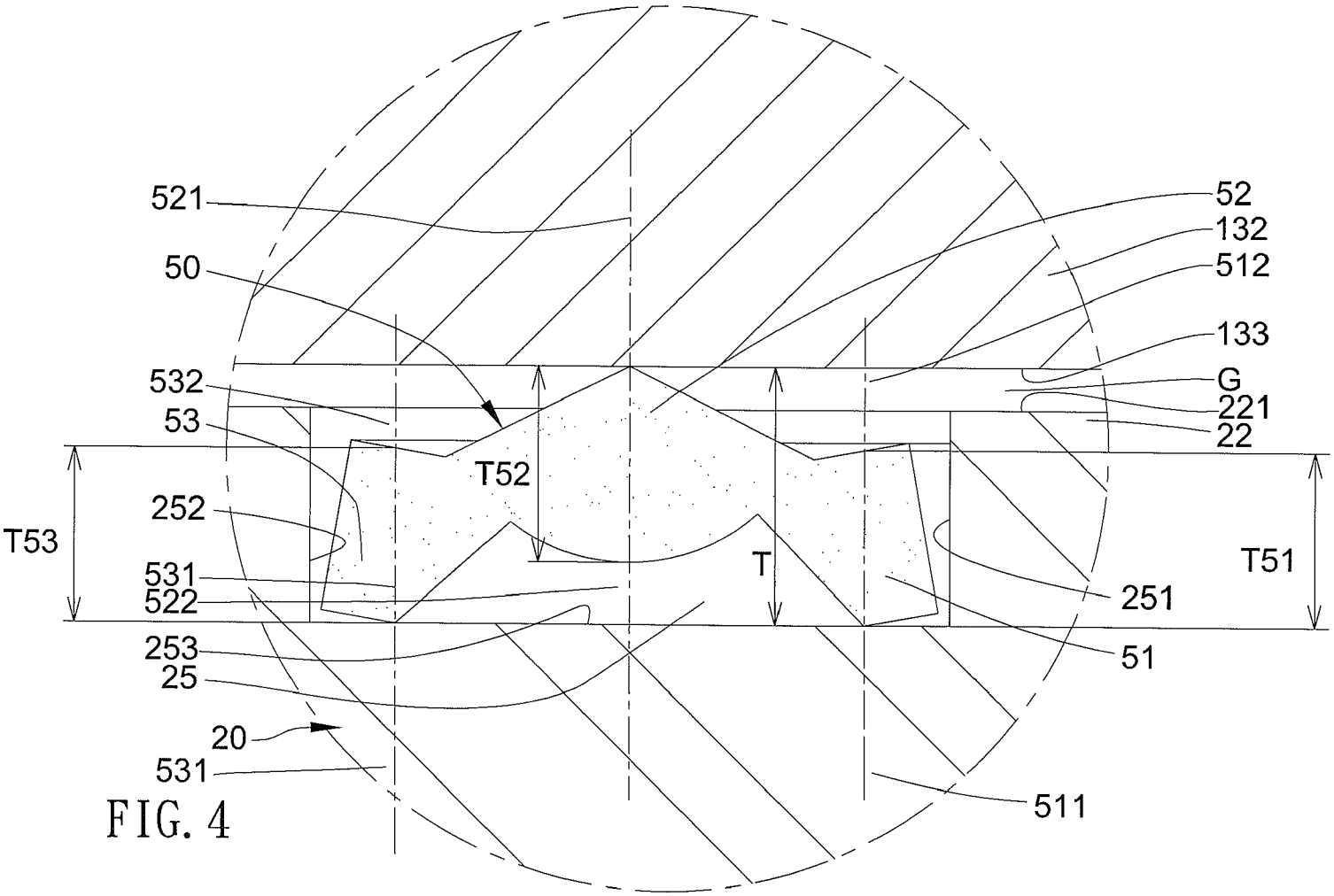
FIG. 4 shows an enlarged view of a circled portion of FIG. 3.
Figure 5:
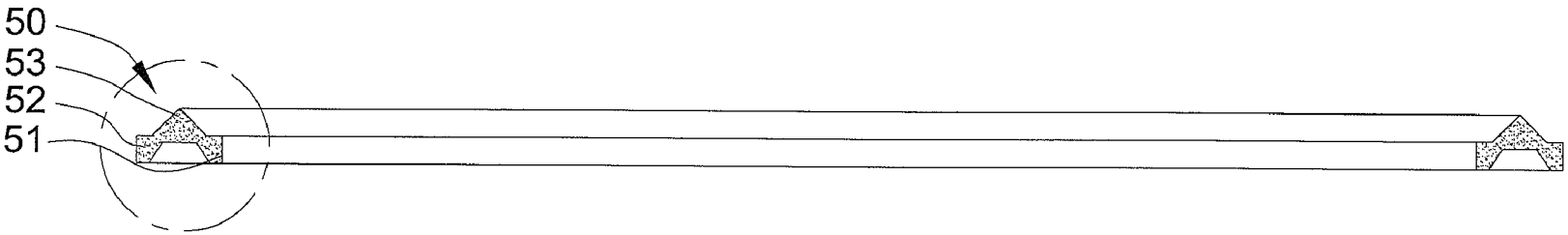
FIG. 5 shows a partial, perspective view of a dustproof ring of FIG. 4 with portions of the dustproof ring broken away and with the dustproof ring in a natural, uncompressed state.
Figure 6:
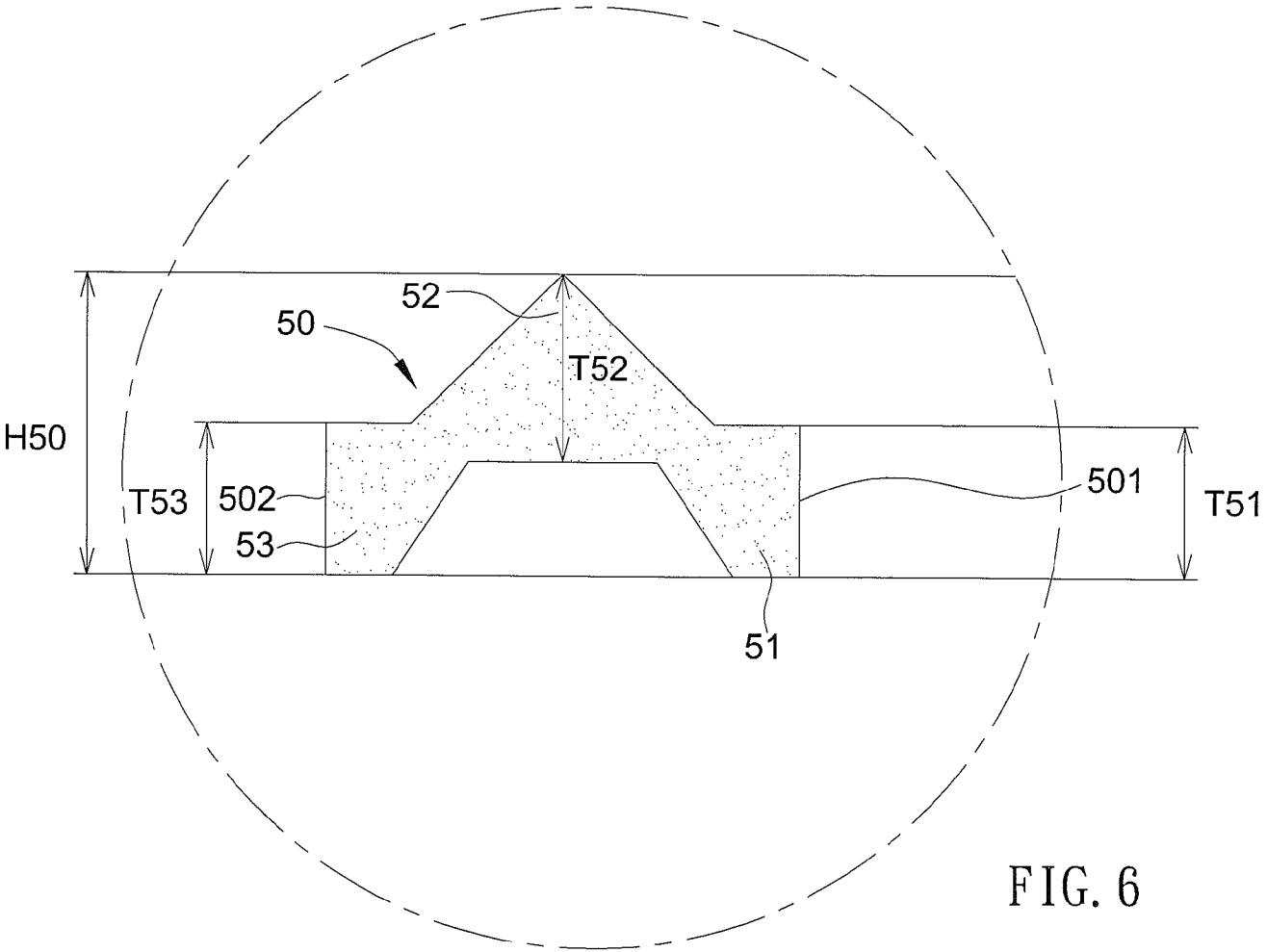
FIG. 6 shows an enlarged view of a circled portion of FIG. 5.
Figure 7:
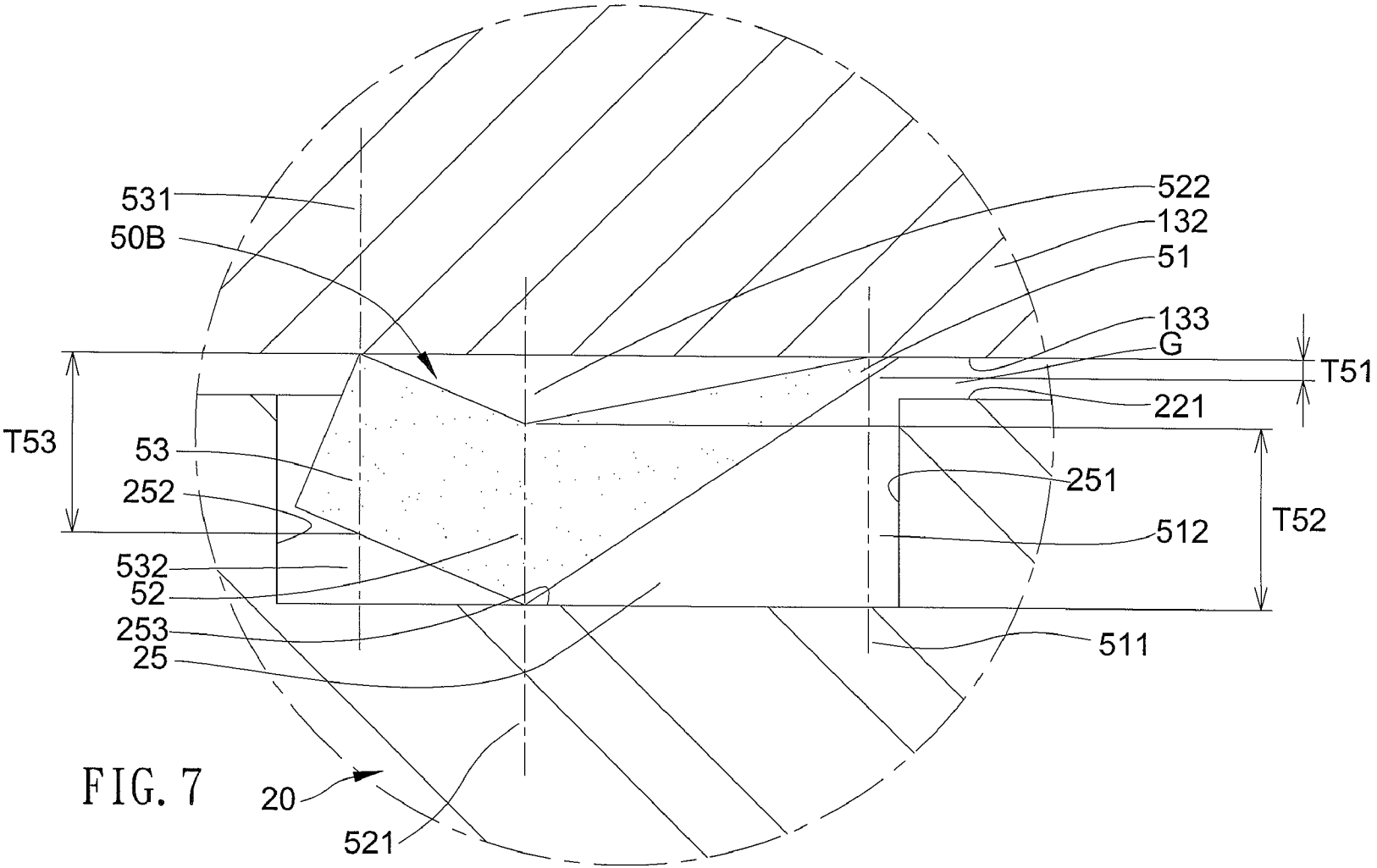
FIG. 7 shows a partial, cross sectional view similar to FIG. 4, illustrating a dustproof ring of a second example according to the preferred teachings of the present invention.
Figure 8:
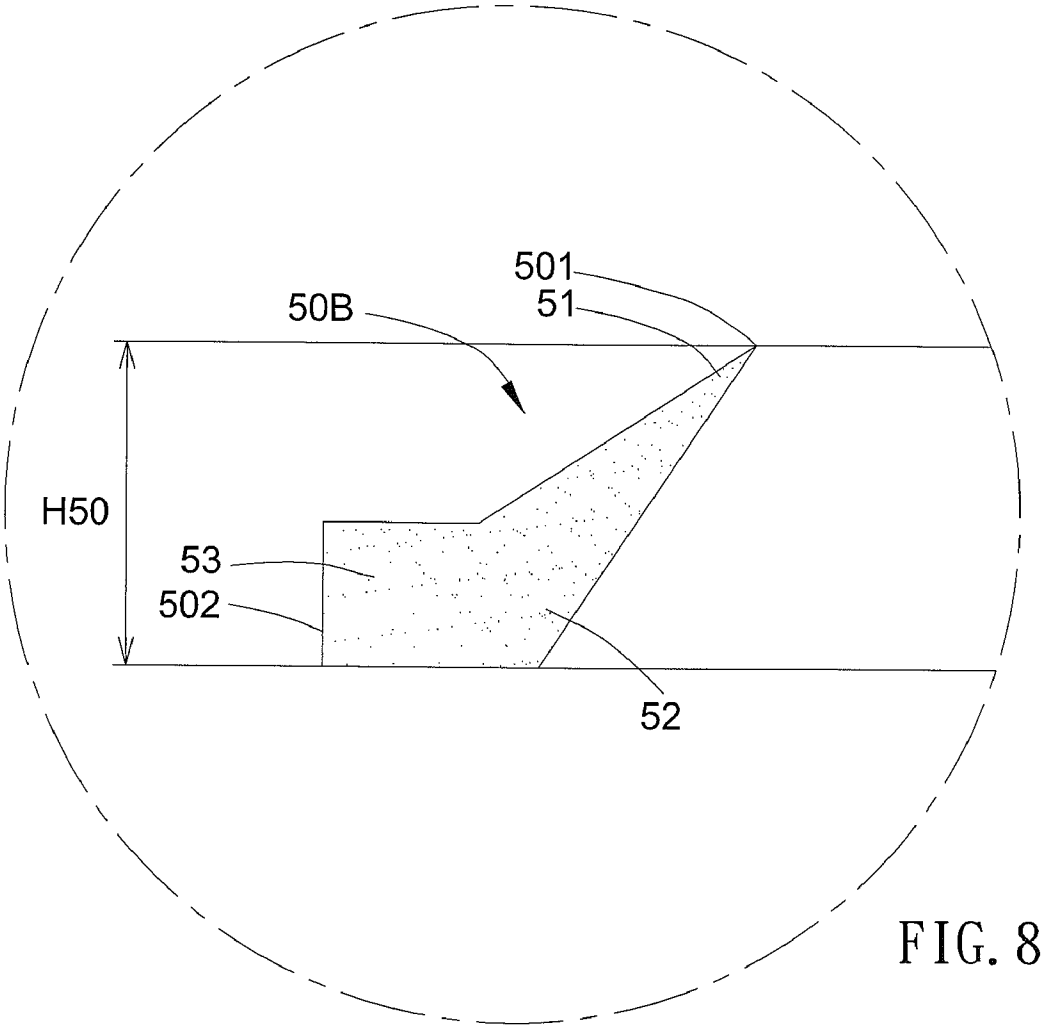
FIG. 8 shows an enlarged view of the dustproof ring of FIG. 7 with the dustproof ring in a natural, uncompressed state.
Figure 9:
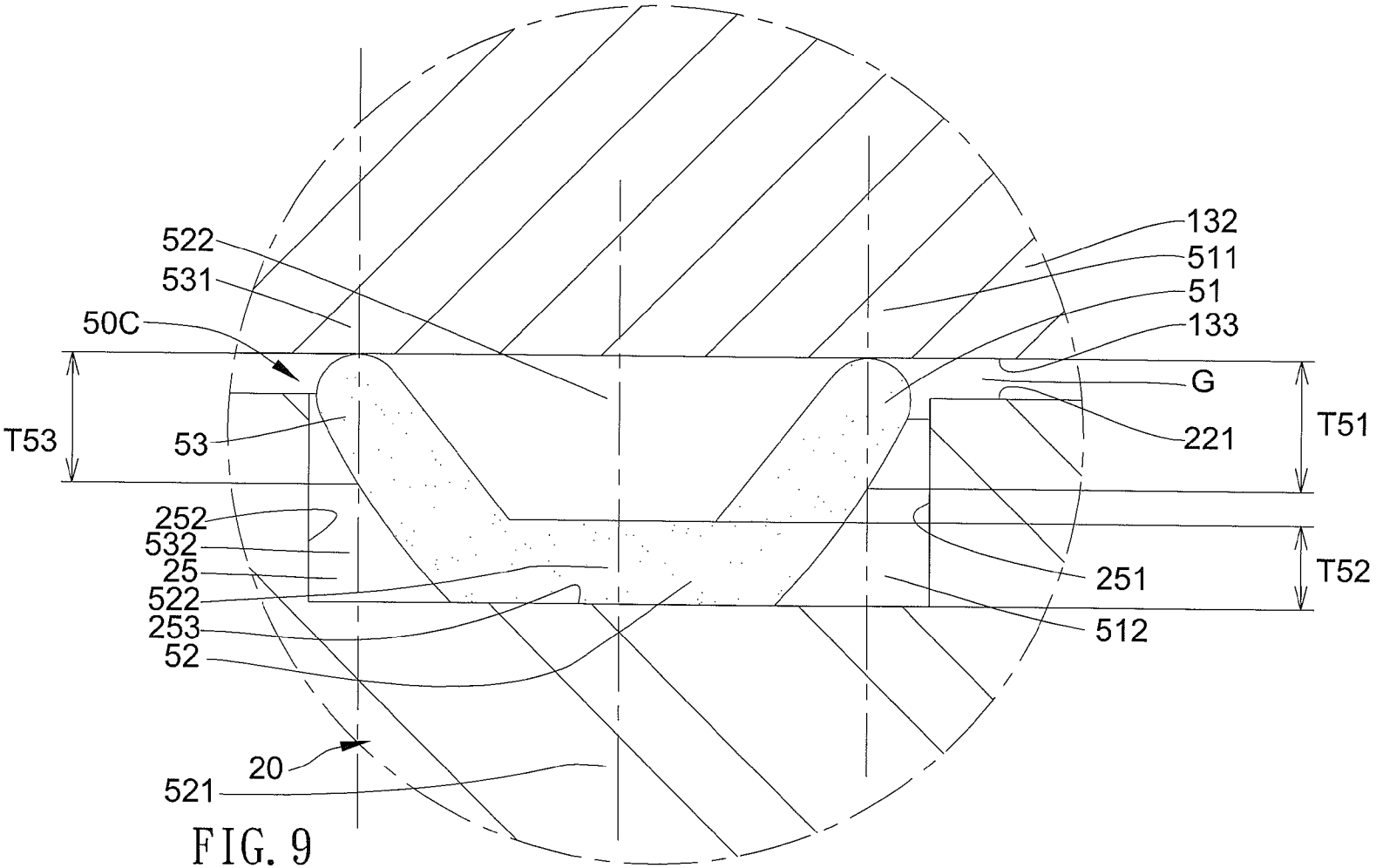
FIG. 9 shows a partial, cross sectional view similar to FIG. 4, illustrating a dustproof ring of a third example according to the preferred teachings of the present invention.
Figure 10:
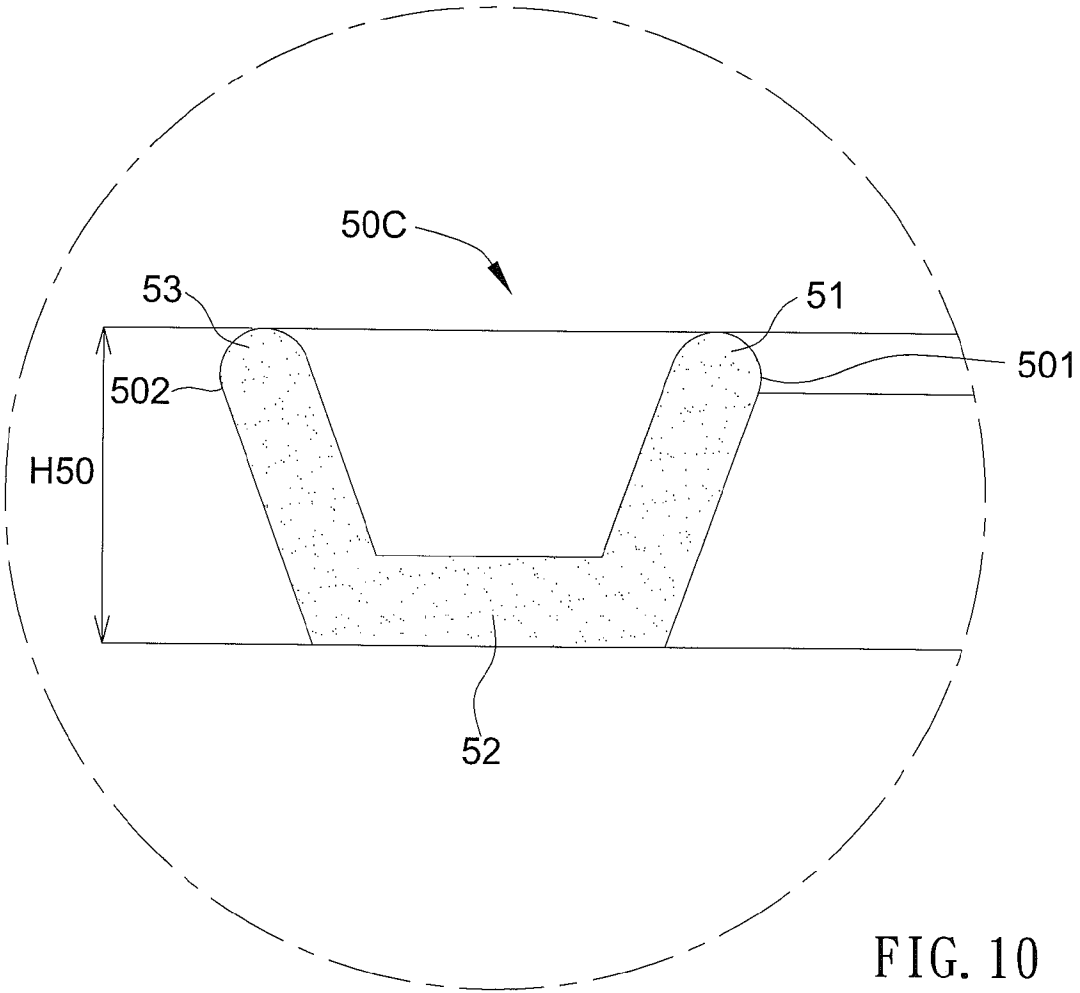
FIG. 10 shows an enlarged view of the dustproof ring of FIG. 9 with the dustproof ring in a natural, uncompressed state.
Figure 11:
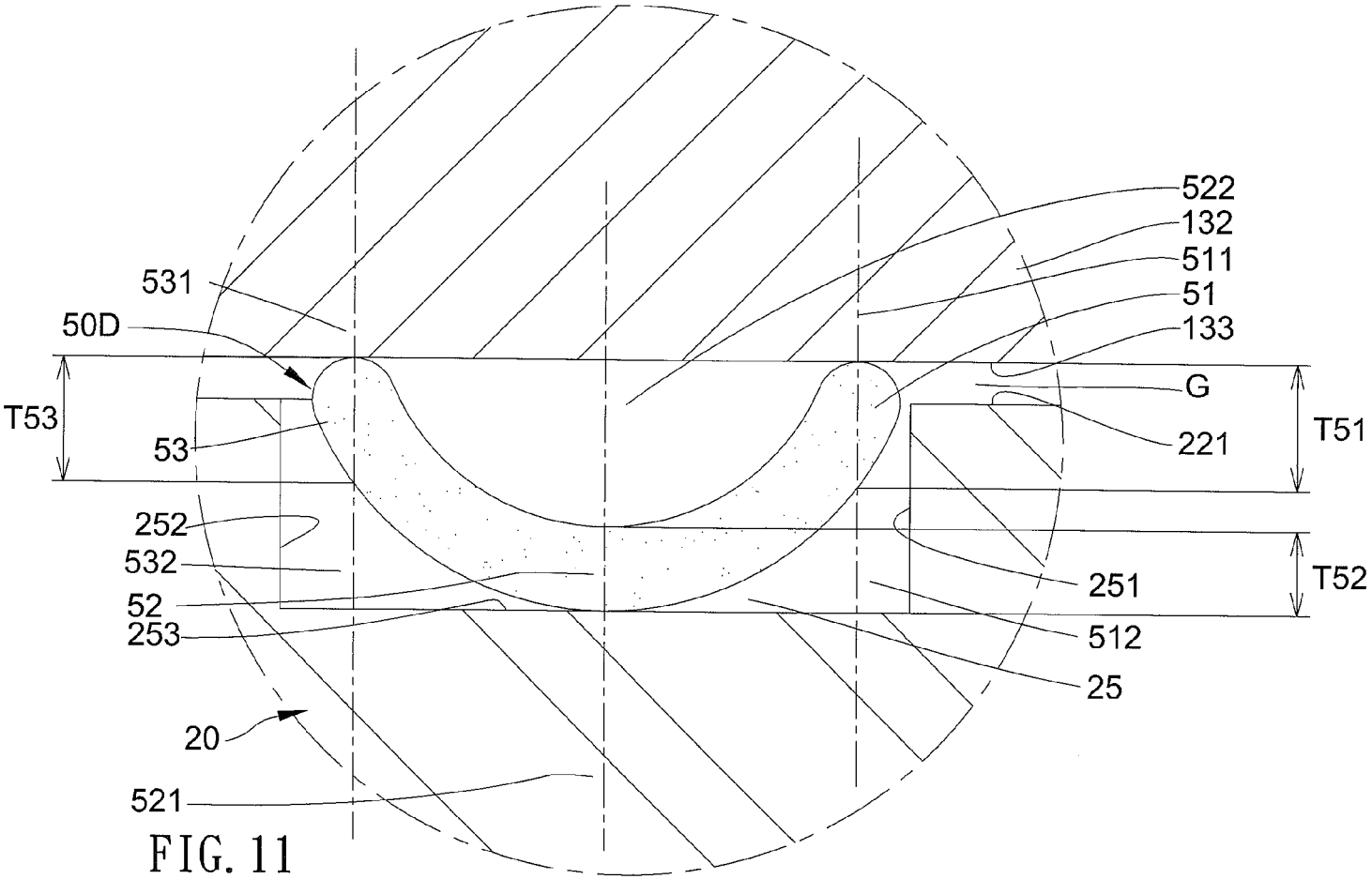
FIG. 11 shows a partial, cross sectional view similar to FIG. 4, illustrating a dustproof ring of a fourth example according to the preferred teachings of the present invention.
Figure 12:
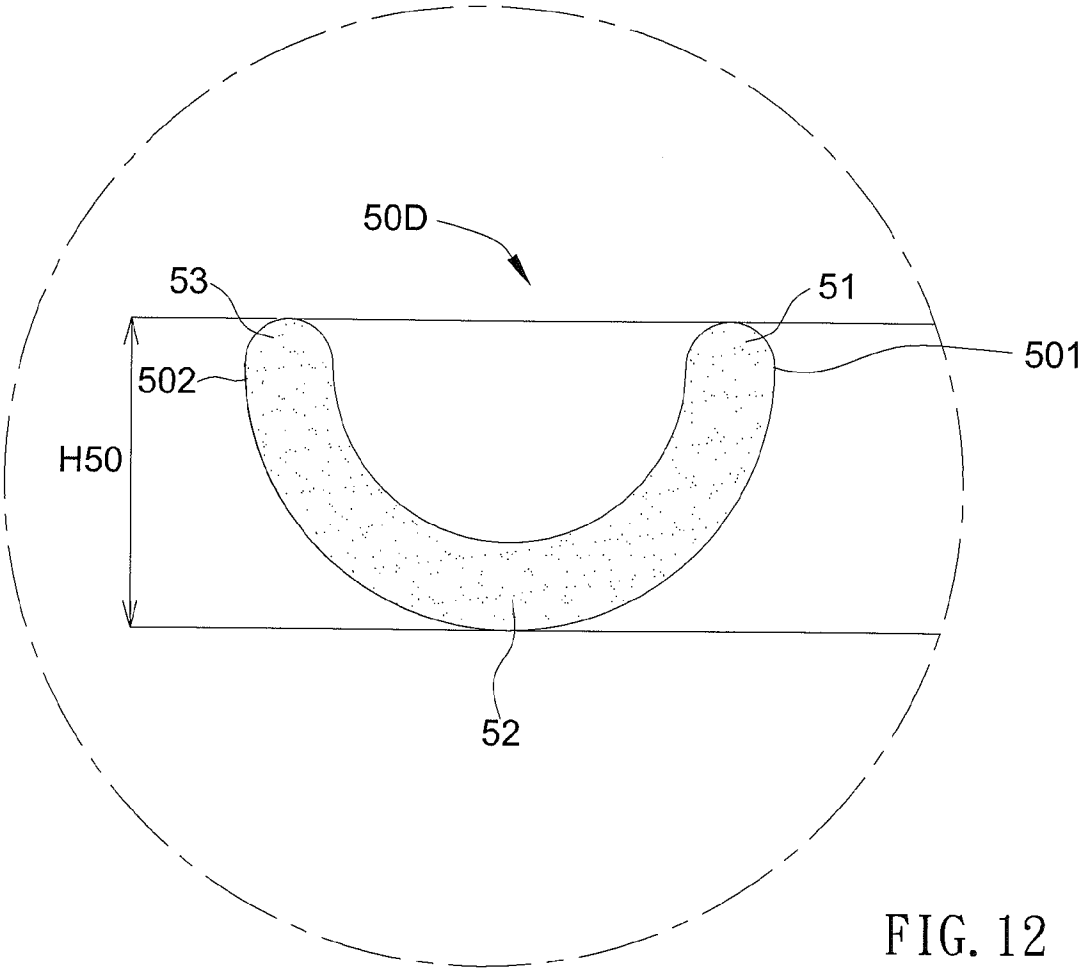
FIG. 12 shows an enlarged view of the dustproof ring of FIG. 11 with the dustproof ring in a natural, uncompressed state.
Figure 13:
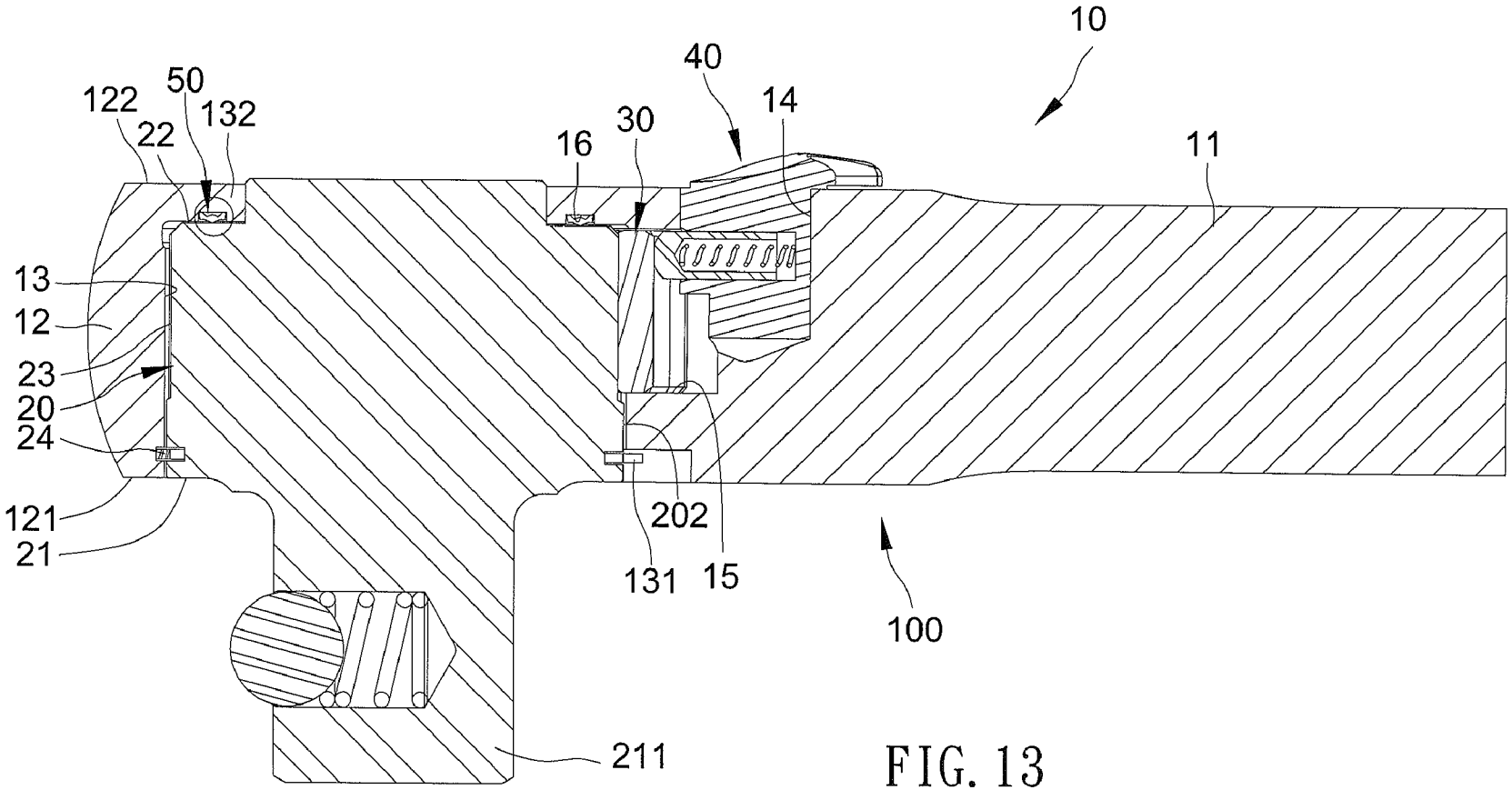
FIG. 13 shows a partial, cross sectional view of a ratchet wrench of a second embodiment according to the preferred teachings of the present invention.
Figure 14:
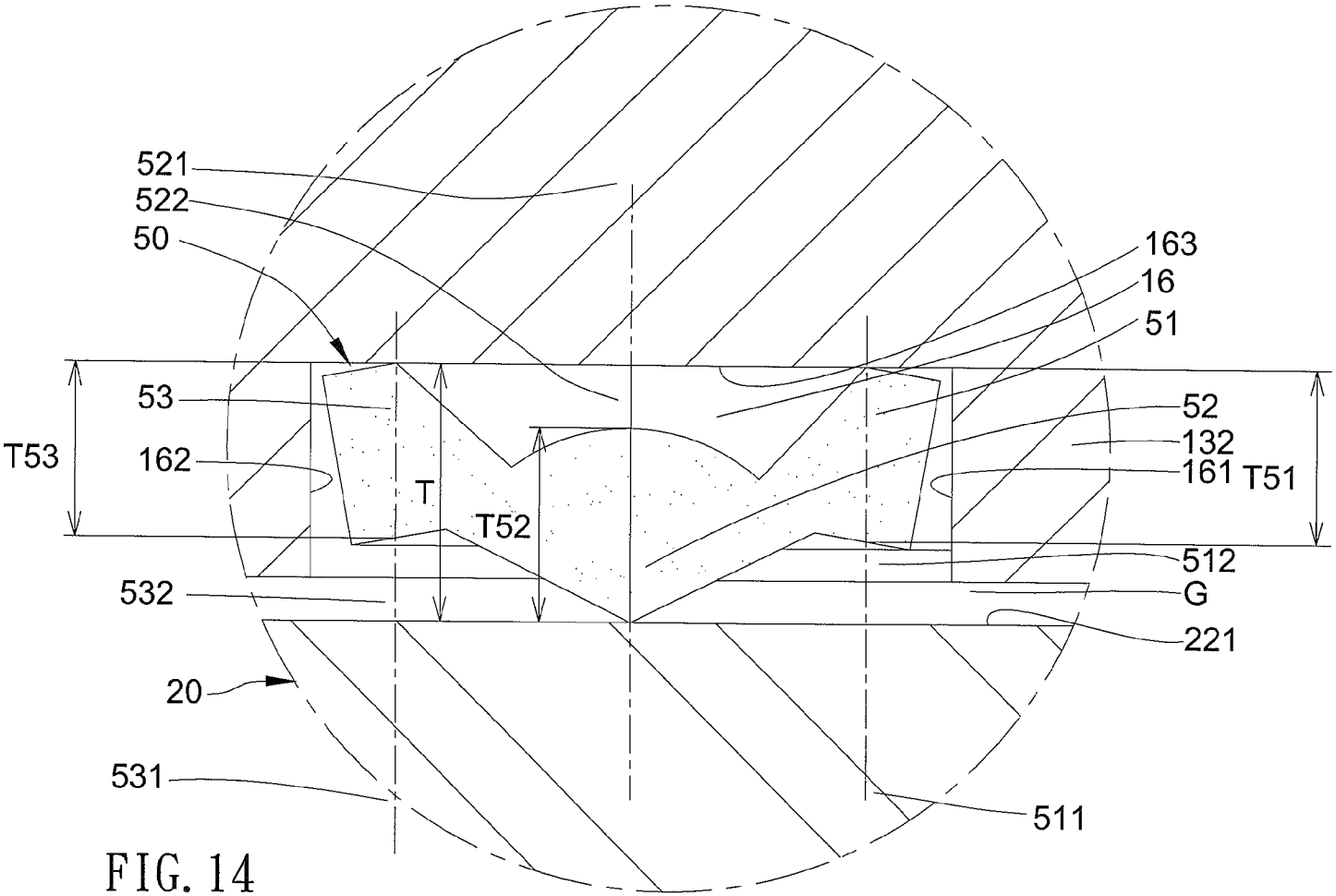
FIG. 14 shows an enlarged view of a circled portion of FIG. 13.

A ratchet wrench according to the preferred teachings of the present invention is shown in the drawings and generally designated 100. In preferred forms shown in FIGS. 1-14, ratchet wrench 100 includes a body 10 having a head 12 and a handle 11 interconnected to head 12. Head 12 includes first and second sides 121 and 122 spaced along a rotating axis L. Head 12 further includes a compartment 13 extending from first side 121 through second side 122. A pawl groove 15 is defined in an inner periphery of compartment 13. Second side 122 of head 12 includes an end wall 132 defining a hole 134 in communication with compartment 13. End wall 132 includes an inner face 133 facing the compartment 13 and an outer face 135 spaced from inner face 133 along rotating axis L. A switch groove 14 is defined in second side 122 of head 12 and in communication with pawl groove 15. Pawl groove 15 is intermediate compartment 13 and switch groove 14 in a radial direction perpendicular to rotating axis L. The inner periphery of compartment 13 further includes an annular retaining groove 131 adjacent first side 121 of head 12.

In the preferred forms shown in FIGS. 1-14, a drive member 20 is rotatably received in compartment 13 about rotating axis L. Drive member 20 includes first and second ends 21 and 22 spaced along rotating axis L. A drive portion 211 is formed on first end 21 of drive member 20 for driving an object such as a sleeve, a fastener, or the like. Drive portion 211 shown in FIGS. 1-14 is a drive column extending beyond first side 121 of head 12 for driving a socket or the like. Second end 22 of drive member 20 includes an end face 221 and a stub 26 extending from end face 221 and rotatably received in hole 134 about rotating axis L. A gap G is formed between end face 221 and inner face 133 along rotating axis L. Drive member 20 further includes an outer periphery 202 extending between first and second ends 21 and 22. A plurality of teeth 23 is formed in outer periphery 202 of drive member 20. An annular groove 201 is formed in outer periphery 202 at first end 21. A retaining member 24 is received in annular groove 201 of drive member 20 and retaining groove 131 of head 12, allowing relative rotational movement between head 12 and drive member 20. It can be appreciated that drive member 20 can have other forms according to the teachings of the present invention. As an example, drive member 20 does not have to include stub 26 and drive column 211. Furthermore, drive member 20 can include a through hole extending from first end 21 through second end 22 and having an inner periphery for driving a fastener such as a nut, bolt head, or the like.

In the preferred forms shown in FIGS. 1-14, one of end face 221 and inner face 133 defines a first abutment face, and the other of end face 221 and inner face 133 includes an annular groove 16, 25 having a bottom wall 163, 253 defining a second abutment face. The first and second abutment faces are perpendicular to rotating axis L. A spacing T is defined between the first and second abutment faces along rotating axis L. Annular groove 16, 25 is spaced from hole 134 of end wall 132 in the radial direction. Furthermore, annular groove 16, 25 includes an outer peripheral face 162, 252 and an inner peripheral face 161, 251 intermediate outer peripheral face 162, 252 and rotating axis L in the radial direction. Bottom wall 163, 253 extends between inner and outer peripheral faces 161 and 162, 251 and 252. In the preferred form shown in FIGS. 1-12, annular groove 25 is formed in end face 221 of drive member 20, bottom wall 253 of annular groove 25 defines the second abutment face, and inner face 133 of end wall 13 defines the first abutment face. In the preferred form shown in FIGS. 13-14, annular groove 16 is formed in inner face 133 of end wall 13, bottom wall 163 of annular groove 16 defines the second abutment face, and end face 221 of drive member 20 defines the first abutment face.

In the preferred forms shown in FIGS. 1-14, a pawl 30 is slideably received in pawl groove 15 and includes a first side 33 having a plurality of teeth 31 releasably engaged with teeth 23 of drive member 20. Pawl 30 further includes a second side 34 having a pressing portion 32 facing switch groove 14.

In the preferred forms shown in FIGS. 1-14, a control device 40 is mounted in switch groove 14 for controlling a driving direction of ratchet wrench 100. Specifically, control device 40 includes a switch 41 rotatably received in switch groove 14, a spring 42 received in a receptacle in switch 41, and a pressing member 43 biased by spring 42 to press against pressing portion 32. An end of pressing member 43 is received in the receptacle of switch 41 and includes a receptacle 431 receiving spring 42. Teeth 31 of pawl 30 are biased by spring 42 to engage with teeth 23 of drive member 20. Switch 41 is rotatable between two positions, so that the other end of pressing member 43 selectively presses against two ends of pressing portion 32. Specifically, when pressing member 43 presses one of the ends of pressing portion 32, head 12 and drive member 20 can rotate jointly in, e.g., a clockwise direction for driving the object, and head 12 can rotate freely in a counterclockwise direction relative to drive member 20 without driving the object. On the other hand, when pressing member 43 presses the other end of pressing portion 32, head 12 and drive member 20 can rotate jointly in the counterclockwise direction for driving the object, and head 12 can rotate freely in the clockwise direction relative to drive member 20 without driving the object. Thus, the driving direction of ratchet wrench 100 can be changed by operating switch 14. Other forms of control device 40 for changing the driving direction of drive member 20 would be within the skill of the art.

In the preferred forms shown in FIGS. 1-14, a dustproof ring 50, 50B, 50C, 50D is mounted in annular groove 16, 25 and compressed. Furthermore, dustproof ring 50, 50B, 50C, 50D presses against the first and second abutment faces. Dustproof ring 50, 50B, 50C, 50D in the uncompressed state has a natural maximum height HSO along rotating axis L larger than spacing T. Dustproof ring 50, 50B, 50C, 50D includes first, second, and third sealing units 51, 52, and 53. Third sealing unit 53 is radially outwards of first sealing unit 51 in the radial direction. Second sealing unit 52 is interconnected to and intermediate first and third sealing units 51 and 53 in the radial direction. First sealing unit 51 includes a first thickness T51 along a first axis 511 parallel to and spaced from rotating axis L. Second sealing unit 52 includes a second thickness T52 along a second axis 521 parallel to and spaced from rotating axis L and first axis 511. Third sealing unit 53 includes a third thickness T53 along a third axis 531 parallel to and spaced from rotating axis L and first and second axes 511 and 521. Second axis 52 is intermediate first and third axes 51 and 53 in the radial direction. Each of first, second, and third thicknesses T51, T52, and T53 is smaller than spacing T. Dustproof ring 50, 50B, 50C, 50D includes an inner periphery 501 and an outer periphery 502 radially outwards of inner periphery 501 in the radial direction. First sealing unit 51 includes inner periphery 501, and third sealing unit 53 includes outer periphery 502. Second axis 521 is intermediate inner and outer peripheries 501 and 502 in the radial direction. First axis 511 is intermediate inner periphery 501 and second axis 521 in the radial direction. Third axis 531 is intermediate second axis 521 and outer periphery 502 in the radial direction. A buffering space is formed between first and third sealing units 51 and 53. The buffering space receives deformed portions of dustproof ring 50, 50B, 50C, 50D received in annular groove 16, 25.

In the preferred forms shown in FIGS. 1-14, first and third sealing units 51 and 53 press against one of the first and second abutment faces, and second sealing unit 52 presses against the other of the first and second abutment faces. In the preferred form shown in FIGS. 1-6, first and third sealing units 51 and 53 press against bottom wall 253 of annular groove 25, and second sealing unit 52 presses against inner face 133 of end wall 132. In the preferred forms shown in FIGS. 7-14, first and third sealing units 51 and 53 press against inner face 133 of end wall 132, and second sealing unit 52 presses against bottom wall 253 of annular groove 25.

In the preferred forms shown in FIGS. 1-14, the buffering space includes a first buffering space section 512 formed between first sealing unit 51 and one of the first and second abutment faces, a second buffering space section 522 formed between second sealing unit 52 and the other of the first and second abutment faces, and a third buffering space section 532 formed between third sealing unit 53 and the one of the first and second abutment faces.

In the preferred form shown in FIGS. 1-6, second sealing unit 52 of dustproof ring 50 has substantially triangular cross sections, and each of first and third buffering space sections 512 and 532 of dustproof ring 50 has substantially trapezoidal cross sections. Second buffering space section 522 has substantially trapezoidal cross sections. In the preferred form shown in FIGS. 7 and 8, dustproof ring 50B in the uncompressed state is asymmetric in cross section. First sealing unit 51 of dustproof ring 50B has substantially triangular cross sections, and third sealing unit 53 of dustproof ring 50B has substantially rectangular cross sections. In the preferred form shown in FIGS. 9 and 10, second sealing unit 52 of dustproof ring 50C includes two end portions spaced in the radial direction and having substantially rectangular cross sections. First and third sealing units 51 and 53 of dustproof ring 50C respectively extend from the end portions of second sealing unit 52. Second buffering space section 522 of dustproof ring 50C has substantially trapezoidal cross sections. In the preferred form shown in FIGS. 11 and 12, dustproof ring 50D has arc-shaped cross sections.

As mentioned above, dustproof ring 50, 50B, 50C, 50D in the uncompressed state has a natural maximum height HSO along rotating axis L larger than spacing T. In the preferred form shown in FIGS. 1-6, first and third buffering space sections 512 and 532 allow movement of first and third sealing unit 51 and 53 toward end face 133, and second buffering space section 522 allows movement of second sealing unit 52 toward bottom wall 253 of annular groove 25. In the preferred forms shown in FIGS. 7-12, first and third buffering space sections 512 and 532 allow movement of first and third sealing unit 51 and 53 toward bottom wall 253 of annular groove 25, and second buffering space section 522 allows movement of second sealing unit 52 toward end face 133. In the preferred form shown in FIGS. 13-14, first and third buffering space sections 512 and 532 allow movement of first and third sealing unit 51 and 53 toward end face 221 of drive member 20, and second buffering space section 522 allows movement of second sealing unit 52 toward bottom wall 163 of annular groove 16. Thus, dustproof ring 50, 50B, 50C, 50D received in annular groove 16, 25 is compressed along rotating axis L and deformed along rotating axis L and in the radial direction with first, second, and third buffering space sections 512, 522, and 532 receiving the deformed portions of dustproof ring 50, 50B, 50C, 50D. In the preferred forms shown in FIGS. 1-14, first, second, and third buffering space sections 512, 522, and 532 are isolated from each other. Gap G between the first and second abutment faces is, thus, sealed to prevent dust from entering compartment 13 of head 12 via hole 134. Furthermore, each of first, second, and third buffering sealing units 51, 52, and 53 is compressed by only one of the first and second abutment faces, so that the friction to each of first, second, and third sealing units 51, 52, and 53 is small, allowing smooth rotation of drive member 20 relative to head 12.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a body including a head and a handle interconnected to the head, with the head including first and second sides spaced along a rotating axis, with the head further including a compartment extending from the first side through the second side, with a pawl groove defined in an inner periphery of the compartment, with the second side of the head including an end wall defining a hole in communication with the compartment, with the end wall including an inner face facing the compartment, a drive member rotatably received in the compartment about the rotating axis, with the drive member including first and second ends spaced along the rotating axis, with the second end of the drive member including an end face, with a gap formed between the end face and the inner face along the rotating axis, with one of the end face and the inner face defining a first abutment face, with the other of the end face and the inner face including an annular groove, with the annular groove having a bottom wall defining a second abutment face, with a spacing defined between the first and second abutment faces along the rotating axis, with the first end of the drive member adapted to drive an object, with the drive member further including an outer periphery extending between the first and second ends, with a plurality of teeth formed in the outer periphery of the drive member;

a pawl slideably received in the pawl groove and including a side having a plurality of teeth engaged with the plurality of teeth of the drive member; and a dustproof ring mounted and compressed in the annular groove, with the dust ring pressing against the first and second abutment faces, with the dustproof ring in an uncompressed state having a natural maximum height along the rotating axis larger than the spacing, with the dustproof ring including first, second, and third sealing units, with the third sealing unit radially outwards of the first sealing unit in a radial direction perpendicular to the rotating axis, with the second sealing unit interconnected to and intermediate the first and third sealing units in the radial direction, with the first sealing unit including a first thickness along a first axis parallel to and spaced from the rotating axis, with the second sealing unit including a second thickness along a second axis parallel to and spaced from the rotating axis and the first axis, with the third sealing unit including a third thickness along a third axis parallel to and spaced from the rotating axis and the first and second axes, with the second axis intermediate the first and third axes in the radial direction, with each of the first, second, and third thicknesses smaller than the spacing, with a buffering space formed between the first and third sealing units, with the buffering space receiving deformed portions of the dustproof ring received in the annular groove.

2. The ratchet wrench as claimed in claim 1, with the annular groove formed in the end face of the drive member, and with the inner face of the end wall defining the first abutment face.

3. The ratchet wrench as claimed in claim 2, with the first and third sealing units pressing against one of the first and second abutment faces, and with the second sealing unit pressing against the other of the first and second abutment faces.

4. The ratchet wrench as claimed in claim 3, with the buffering space including a first buffering space section formed between the first sealing unit and one of the first and second abutment faces, a second buffering space section formed between the second sealing unit and the other of the first and second abutment faces, and a third buffering space section formed between the third sealing unit and the one of the first and second abutment faces.

5. The ratchet wrench as claimed in claim 4, with the dustproof ring received in the annular groove being compressed along the rotating axis and deformed along the rotating axis and in the radial direction, and with the first, second, and third buffering space sections isolated from each other.

6. The ratchet wrench as claimed in claim 5, with the dustproof ring including an inner periphery and an outer periphery radially outwards of the inner periphery in the radial direction, with the first sealing unit including the inner periphery, with the third sealing unit including the outer periphery, with the second axis intermediate the inner and outer peripheries in the radial direction, with the first axis intermediate the inner periphery and the second axis in the radial direction, with the third axis intermediate the second axis and the outer periphery in the radial direction.

7. The ratchet wrench as claimed in claim 5, with the annular groove spaced from the hole in the radial direction, with the annular groove including an outer peripheral face and an inner peripheral face intermediate the outer peripheral face and the rotating axis in the radial direction, with the bottom wall extending between the inner and outer peripheral faces, and with the first and second abutment faces extending perpendicularly to the rotating axis.

8. The ratchet wrench as claimed in claim 5, with the second sealing unit having substantially triangular cross sections, with each of the first and third buffering space sections having substantially trapezoidal cross sections, and with the second buffering space section having substantially trapezoidal cross sections.

9. The ratchet wrench as claimed in claim 5, with the dustproof ring in the uncompressed state being asymmetric in cross section, with the first sealing unit having substantially triangular cross sections, and with the third sealing unit having substantially rectangular cross sections.

10. The ratchet wrench as claimed in claim 5, with the second sealing unit including two end portions spaced in the radial direction and having substantially rectangular cross sections, with the first and third sealing units respectively extending from the two end portions of the second sealing unit, and with the second buffering space section having substantially trapezoidal cross sections.

11. The ratchet wrench as claimed in claim 1, with the annular groove formed in the inner face of the end wall, and with the end face of the drive member defining the first abutment face.

12. The ratchet wrench as claimed in claim 11, with the first and third sealing units pressing against one of the first and second abutment faces, and with the second sealing unit pressing against the other of the first and second abutment faces.

13. The ratchet wrench as claimed in claim 12, with the buffering space including a first buffering space section formed between the first sealing unit and one of the first and second abutment faces, a second buffering space section formed between the second sealing unit and the other of the first and second abutment faces, and a third buffering space section formed between the third sealing unit and the one of the first and second abutment faces.

14. The ratchet wrench as claimed in claim 13, with the dustproof ring received in the annular groove being compressed along the rotating axis and deformed along the rotating axis and in the radial direction, and with the first, second, and third buffering space sections isolated from each other.

15. The ratchet wrench as claimed in claim 14, with the dustproof ring including an inner periphery and an outer periphery radially outwards of the inner periphery in the radial direction, with the first sealing unit including the inner periphery, with the third sealing unit including the outer periphery, with the second axis intermediate the inner and outer peripheries in the radial direction, with the first axis intermediate the inner periphery and the second axis in the radial direction, with the third axis intermediate the second axis and the outer periphery in the radial direction.

16. The ratchet wrench as claimed in claim 14, with the annular groove spaced from the hole in the radial direction, with the annular groove including an outer peripheral face and an inner peripheral face intermediate the outer peripheral face and the rotating axis in the radial direction, with the bottom wall extending between the inner and outer peripheral faces, and with the first and second abutment faces extending perpendicularly to the rotating axis.

17. The ratchet wrench as claimed in claim 14, with the second sealing unit having substantially triangular cross sections, with each of the first and third buffering space sections having substantially trapezoidal cross sections, and with the second buffering space section having substantially trapezoidal cross sections.

18. The ratchet wrench as claimed in claim 14, with the dustproof ring in the uncompressed state being asymmetric in cross section, with the first sealing unit having substantially triangular cross sections, and with the third sealing unit having substantially rectangular cross sections.

19. The ratchet wrench as claimed in claim 14, with the second sealing unit including two end portions spaced in the radial direction and having substantially rectangular cross sections, with the first and third sealing units respectively extending from the two end portions of the second sealing unit, and with the second buffering space section having substantially trapezoidal cross sections.

20. The ratchet wrench as claimed in claim 14, with the dustproof ring having arc-shaped cross sections.

* * * * *